US009510728B2

(12) United States Patent
Tuller

(10) Patent No.: US 9,510,728 B2
(45) Date of Patent: Dec. 6, 2016

(54) REDUCED VAPOR DRY SYSTEMS AND METHODS FOR DISHWASHERS

(71) Applicant: Whirlpool Corporation, Benton Harbor, MI (US)

(72) Inventor: Barry E. Tuller, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 107 days.

(21) Appl. No.: 14/548,422

(22) Filed: Nov. 20, 2014

(65) Prior Publication Data

US 2016/0143507 A1 May 26, 2016

(51) Int. Cl.
*A47L 15/48* (2006.01)

(52) U.S. Cl.
CPC ..... *A47L 15/488* (2013.01); *A47L 15/483* (2013.01); *A47L 15/486* (2013.01)

(58) Field of Classification Search
CPC ..... A47L 15/00; A47L 15/42; A47L 15/48; F26B 19/00; F26B 21/00; F26B 21/06; B08B 3/00; D06F 58/00; D06F 58/20; D06F 58/23
USPC ..... 34/90, 595, 524, 497, 601, 606, 610; 68/5 C, 5 R, 19, 20; 134/58 D, 95.2
See application file for complete search history.

(56) References Cited

U.S. PATENT DOCUMENTS 3,876,469 A 4/1975 Schimke
4,515,145 A * 5/1985 Tallman ..... F24D 19/1084 126/109
4,709,488 A 12/1987 Anselmino et al.
5,875,802 A * 3/1999 Favaro ..... A47L 15/483 134/102.3
7,103,992 B2 * 9/2006 Duden ..... A47L 15/4291 134/102.3
7,222,439 B2 * 5/2007 Paintner ..... A47L 15/0013 34/595
7,347,005 B2 * 3/2008 Cerruti ..... A47L 15/486 134/95.2
7,367,134 B2 * 5/2008 Osvatic ..... D06F 58/20 137/514
9,052,143 B2 * 6/2015 Janowski ..... A47L 19/04
2007/0251552 A1 * 11/2007 Lee ..... A47L 15/4251 134/56 D
2008/0210279 A1 * 9/2008 Hildenbrand ..... A47L 15/0081 134/56 D
2008/0264455 A1 * 10/2008 Brewer ..... A47L 15/483 134/95.2

(Continued)

FOREIGN PATENT DOCUMENTS

CH 683819 A5 5/1994
CH 1825800 A3 * 5/2008 ..... A47L 15/4246

(Continued)

*Primary Examiner* — Stephen Gravini

(57) ABSTRACT

An example vent assembly for a dishwasher having a tub at least partially defining a treating chamber, and an exhaust vent, includes a condenser having an outlet, and an inlet in fluid communication with the treating chamber, an ambient air cooling duct in thermal communication with the condenser, and having an outlet in fluid communication with the exhaust vent, a venturi having an inlet in communication with the outlet of the condenser, and an outlet in communication with the cooling duct, and a fan for flowing ambient air through the cooling duct, past the venturi, and out the exhaust vent.

20 Claims, 3 Drawing Sheets

(56) References Cited

U.S. PATENT DOCUMENTS

| | | | | |
|---|---|---|---|---|
| 2010/0294323 | A1* | 11/2010 | Brunswick | A47L 15/4291 134/56 D |
| 2011/0126864 | A1* | 6/2011 | Kim | A47L 15/486 134/25.2 |

FOREIGN PATENT DOCUMENTS

| | | | | |
|---|---|---|---|---|
| DE | 102012025591 | A1 * | 7/2013 | A47L 15/0013 |
| DE | 102013107087 | A1 * | 3/2014 | A47L 15/4246 |
| DE | 2014162185 | * | 10/2014 | A21B 3/04 |
| EP | 0378836 | A1 | 7/1990 | |
| EP | 1447042 | B1 | 4/2007 | |
| EP | 1825800 | A2 | 8/2007 | |
| JP | 5344948 | A | 12/1993 | |

* cited by examiner

REDUCED VAPOR DRY SYSTEMS AND METHODS FOR DISHWASHERS

FIELD OF THE DISCLOSURE

This disclosure relates generally to dishwashers, and, more particularly, to reduced vapor dry systems and methods for dishwashers.

BACKGROUND

Conventional dishwashers perform cycles of operation on items present in the dishwasher, and have vents that exhaust hot moist air at the end of a cycle of operation.

SUMMARY

A disclosed example vent assembly for a dishwasher having a tub at least partially defining a treating chamber, and an exhaust vent, includes a condenser having an outlet, and an inlet in fluid communication with the treating chamber, an ambient air cooling duct in thermal communication with the condenser, and having an outlet in fluid communication with the exhaust vent, a venturi having an inlet in communication with the outlet of the condenser, and an outlet in communication with the cooling duct, and a fan for flowing ambient air through the cooling duct, past the venturi, and out the exhaust vent.

A disclosed example method of venting exhaust air from a dishwasher, includes circulating air through a condenser to condense moisture from the air, operating a fan to pass ambient air through a cooling duct to thermally conduct heat from the condenser to the ambient air to condense the moisture, drawing the air from the condenser into the cooling duct through a venturi, and venting a mixture of the ambient air and the air from the condenser through a vent.

DETAILED DESCRIPTION

Drying in a typical dishwasher is accomplished by opening an exhaust vent at the end of a cycle of operation, and exhausting the hot moist air out of the dishwasher into a room (e.g., a kitchen) in which the dishwasher is located. When a conventional exhaust vent is opened it initially creates visible vapor (a.k.a. "dragon's breath"), and exhausts hot moisture laden air into the room. Alternative drying systems have been devised and used on dishwashers. Some are closed systems that attempt to contain all moisture within the dishwasher by condensing out the moisture. These solutions compromise on performance and cost. Other drying systems have placed the vent on the tub within the cabinet, which often result in condensation issues within the cabinet.

Reduced vapor and heat dishwasher exhaust vents and methods that overcome at these problems are disclosed herein. By reducing visible vapor, temperature and associated water condensation, the examples disclosed herein open up possibilities to make vents more aesthetically pleasing, hidden and/or stylish. In general, the examples disclosed herein use a fan in combination with a condensing chamber and a venturi. In some examples, a vent assembly constructed in accordance with the teachings of this disclosure is disposed in the door of a dishwasher. However, it could alternately be disposed on the side of the tub, under the dishwasher, behind the tub, etc.

Figure 1:
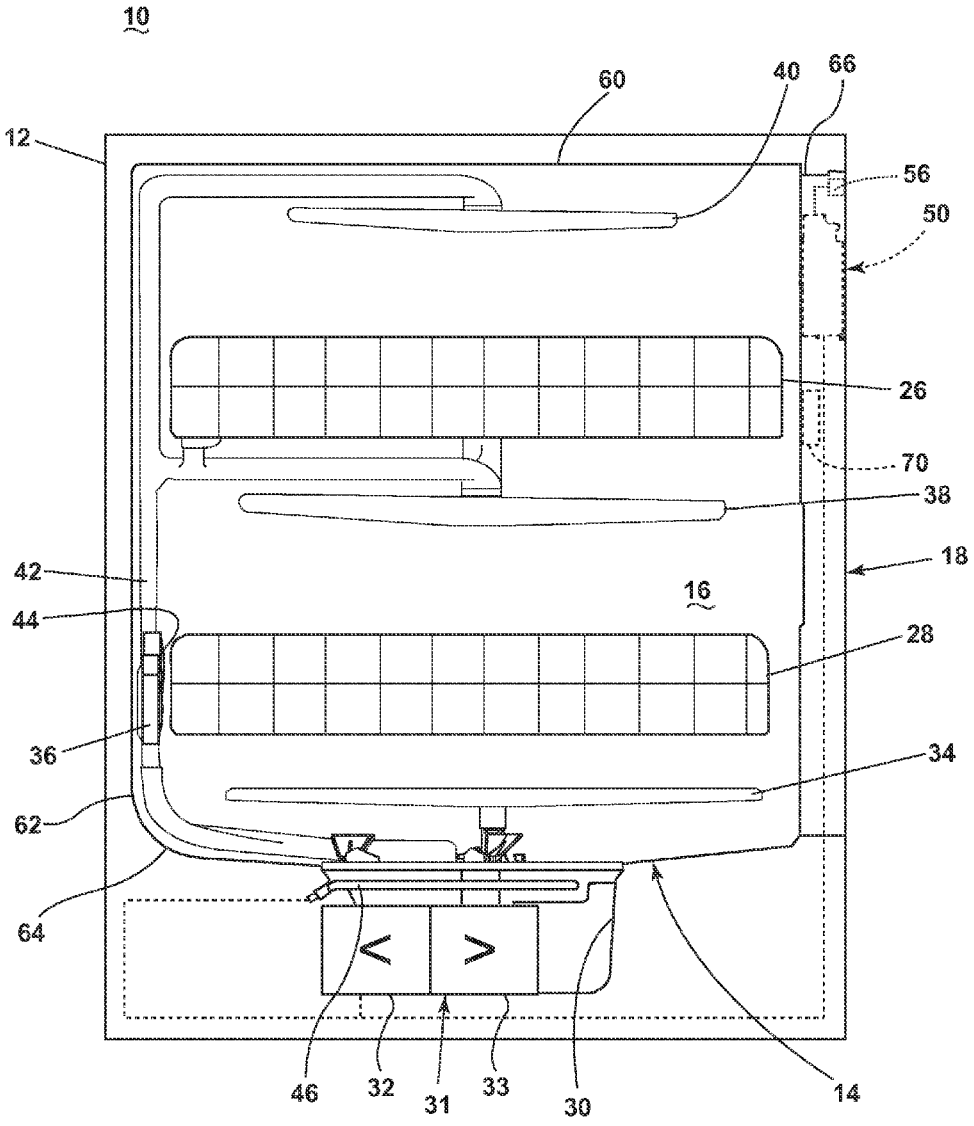
FIG. 1 is a schematic view of an example dishwasher having a reduced vapor and heat vent assembly constructed in accordance with the teachings of this disclosure.

In FIG. 1, an automated dishwasher 10 according to a first embodiment is illustrated. The dishwasher 10 shares many well known features of a conventional automated dishwasher, which will not be described in detail herein except as necessary for a complete understanding of this disclosure. A chassis 12 defines an interior of the example dishwasher 10 and may include a frame, with or without panels mounted to the frame. An open-faced tub 14 is within the chassis 12 and may at least partially define a treating chamber 16, having an open face, for washing dishes. A door assembly 18 is movably mounted to the dishwasher 10 for movement between opened and closed positions to selectively open and close the open face of the tub 14. Thus, the door assembly provides accessibility to the treating chamber 16 for the loading and unloading of dishes or other washable items.

It should be appreciated that the door assembly 18 may be secured to the lower front edge of the chassis 12 or to the lower front edge of the tub 14 via a hinge assembly (not shown) configured to pivot the door assembly 18. When the door assembly 18 is closed, user access to the treating chamber 16 is prevented, whereas user access to the treating chamber 16 is permitted when the door assembly 18 is open.

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders may be provided, such as a silverware basket. As used in this description, the term "dish(es)" is intended to be generic to any item, single or plural, that may be treated in the dishwasher 10, including, without limitation, dishes, plates, pots, bowls, pans, glassware, silverware, any other washable item.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 24 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The example recirculation system includes a sump 30 and a pump assembly 31. The sump 30 collects the liquid sprayed in the treating chamber 16 and may be formed by a sloped or recess portion of a bottom wall of the tub 14. The pump assembly 31 may include both a drain pump 32 and a recirculation pump 33. The drain pump 32 may draw liquid from the sump 30 and pump the liquid out of the dishwasher 10 to a household drain line (not shown). The recirculation pump 33 may draw liquid from the sump 30 and the liquid may be simultaneously or selectively pumped through a supply tube 42 to each of the assemblies 34, 36, 38, 40 for selective spraying. While not shown, a liquid supply system may include a water supply conduit coupled with a household water supply for supplying water to the treating chamber 16.

A heating system including a heater 46 may be located within the sump 30 for heating the liquid contained in the sump 30.

A controller 50 may also be included in the dishwasher 10, which may be operably coupled with various components of the dishwasher 10 to implement a cycle of operation. The controller 50 may be located within the door 18 as illustrated, or it may alternatively be located somewhere within the chassis 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50 and receive information.

To vent warm moist air from the treating chamber 16 during a drying cycle or operation, the example dishwasher 10 of FIG. 1 includes a vent assembly 70 constructed in accordance with the teachings of this disclosure. The vent assembly 70 will be described in detail below in connection with FIG. 3. In the example of FIG. 1, the vent assembly 70 is implemented as a part of the door assembly 18. Alternatively, it could be implemented at other locations, such as at a side wall of the tub 14, behind a tub, beneath a tub, etc.

Figure 2:
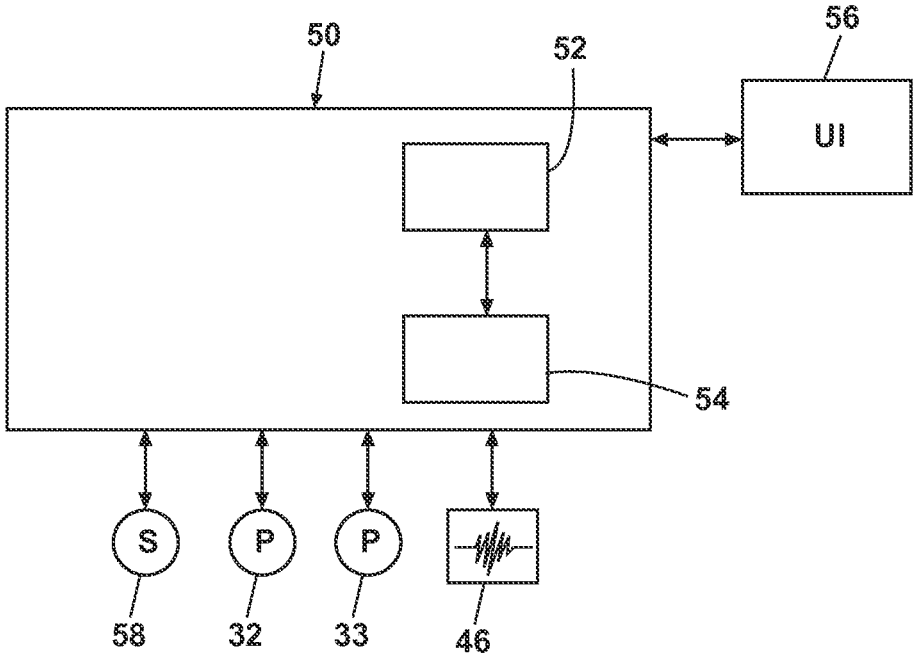
FIG. 2 is a schematic of an example control system for the example dishwasher of FIG. 1.

As illustrated schematically in FIG. 2, the controller 50 may be coupled with the heater 46 for heating the wash liquid during a cycle of operation, the drain pump 32 for draining liquid from the treating chamber 16, and the recirculation pump 33 for recirculating the wash liquid during the cycle of operation. The controller 50 may be provided with a memory 52 and a central processing unit (CPU) or processor 54. The processor 54 can be implemented by, for example, one or more Atmel®, Intel®, AMD®, and/or ARM® microprocessors. Of course, other processors from other processor families and/or manufacturers are also appropriate.

The memory 52 may be used for storing control software that may be executed by the CPU 54 in completing a cycle of operation using the dishwasher 10 and any additional software. For example, the memory 52 may store one or more pre-programmed cycles of operation that may be selected by a user and completed by the dishwasher 10. The memory 52 may include volatile memory such as synchronous dynamic random access memory (SDRAM), a dynamic random access memory (DRAM), RAMBUS® dynamic random access memory (RDRAM) and/or any other type of random access memory (RAM) device(s); and/or non-volatile memory such as flash memory(-ies), or flash memory device(s).

The controller 50 may also receive input from one or more sensors 58. Non-limiting examples of sensors that may be communicably coupled with the controller 50 include a temperature sensor and turbidity sensor to determine the soil load associated with a selected grouping of dishes, such as the dishes associated with a particular area of the treating chamber.

Figure 3:
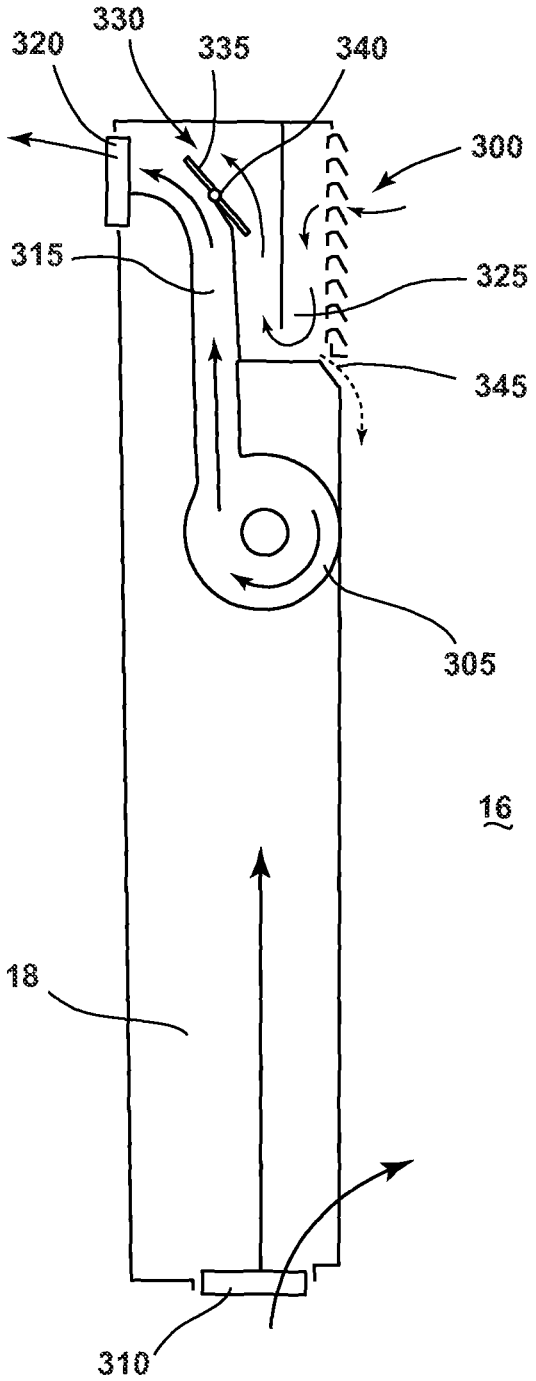
FIG. 3 is a schematic diagram of an example manner of implementing the reduced vapor and heat vent of FIG. 1

Turning to FIG. 3, a schematic diagram of an example manner of implementing the example vent assembly 70 of FIG. 1 is shown. In the example of FIG. 3, a vent assembly 300 is provided in the door assembly 18. However, the vent assembly 70 may be provided at other locations. To provide relatively cool ambient air, the example vent assembly 300 of FIG. 3 includes a fan 305 that draws ambient air in through an ambient air inlet opening or vent 310, passes the air through a cooling duct 315, and exhausts the air out an exhaust opening or vent 320. The outlet of the cooling duct 315 is in fluid communication with the exhaust vent 320, and its inlet is in fluid communication with the inlet vent 310. As shown, cool ambient air also flows through the inlet vent 310 into the treating chamber 16. The exhaust vent 320 may be located at, for example, a front of the door 18, a top edge of the door 18, a bottom edge of the door 18, a side of the door 18, beneath the door 18, on the tub 14, thru a toe kick, etc.

To cool and condense moisture from the air before being exhausted from the treating chamber 16, the example vent assembly 300 includes a condenser 325. The inlet of the condenser 325 is in fluid communication with the treating chamber 16, and as is described below, its outlet is in fluid communication with the cooling duct 315 via a venturi 330. The example condenser 325 may be, for example, a chamber and/or a duct having a tortuous shape or path. Of course, other condenser configurations may be used. As shown in FIG. 3, at least a portion of the cooling duct 315 is in thermal communication with at least a portion of the condenser 325. As the ambient air flows through the cooling duct 315, the ambient air absorbs heat from the air in the condenser 325, thereby condensing moisture from and cooling the air being exhausted from the treating chamber 16 via the condenser 325.

Due to the movement of the air through the cooling duct 315, the venturi 330 positioned between the cooling duct 315 and the condenser 325 draws air from the condenser 325, which has had moisture removed and been cooled, into the cooling duct 315 and out the exhaust vent 320. The inlet of the venturi 330 is in fluid communication with the condenser 325, and its outlet is in fluid communication with the cooling duct 315. The venturi 330 also draws hot moisture laden air into the condenser 325, and ambient air into the treating chamber 16. Because the air drawn through the venturi 330 has been cooled and had moisture removed from it, visible vapor, temperature and associated water condensation at the exhaust vent 320 are reduced.

To control the amount of air allowed to escape or be drawn through the venturi 330, the example vent assembly 300 may include a flapper valve 335. The example flapper valve 335 may be operated so progressively more air passes through the venturi 330 as the temperature and moisture content of the air in the interior 16 of the dishwasher 10 progressively decreases. That is, as the dishwasher 10 progressively cools, the flapper valve 335 is progressively opened wider so more air is allowed to be drawn through from condensing chamber 325 thru the venturi 330 and exhausted from the dishwasher 10. In some examples, the fan 305 is used to power a ratchet mechanism 340 that controls the opening and/or closing of the flapper valve 335. The ratchet 340 may be operated by, for example, turning the fan 305 on and off, e.g., advancing the vent flapper 335 opening by a predetermined increment each time the fan 305 is turned on. The ratchet 340 may be configured so the vent flapper 335 stands open at end of the drying cycle, even with the fan 305 turned off. At the start of next cycle, activation of fan 305 may be used to reset the ratchet 340 and close the flapper valve 335. Opening of the dishwasher door 18 may alternatively be used as a reset of the flapper valve 335. Additionally, the flapper valve 335 could close in response to a rise in air pressure. It should be understood that any additional or alternative means could be used to operate the flapper valve 335. For example, a motor could be used to operate the flapper valve 335. Moreover, any combination of means could be used to operate the flapper valve 335.

Determining how much to open the flapper valve 335 can be fixed cycle, or may be dynamic based on, for example, sensed temperature, sensed humidity, etc. to determine degree of flapper valve opening. It is contemplated that other sensors could be used.

To drain condensate from the condenser 325, the example valve assembly 300 of FIG. 3 includes a drain line or conduit 345. The drain line 345 drains condensate from the condenser 325 into the sump 30 where it may collect or be removed from the dishwasher 10.

In this specification and the appended claims, the singular forms "a," "an" and "the" do not exclude the plural reference unless the context clearly dictates otherwise. Further, conjunctions such as "and," "or," and "and/or" used in this specification and the appended claims are inclusive unless the context clearly dictates otherwise. For example, "A and/or B" includes A alone, B alone, and A with B; "A or B" includes A with B, and "A and B" includes A alone, and B alone. Further still, connecting lines, or connectors shown in the various figures presented are intended to represent example functional relationships and/or physical or logical couplings between the various elements. It should be noted that many alternative or additional functional relationships, physical connections or logical connections may be present in a practical device. Moreover, no item or component is essential to the practice of the embodiments disclosed herein unless the element is specifically described as "essential" or "critical".

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. A vent assembly for a dishwasher having a tub at least partially defining a treating chamber, and an exhaust vent, the vent assembly comprising:

a condenser having an outlet, and an inlet in fluid communication with the treating chamber of the dishwasher;

an ambient air cooling duct in thermal communication with the condenser, and having an outlet in fluid communication with the exhaust vent;

a venturi having an inlet in communication with the outlet of the condenser, and an outlet in communication with the cooling duct; and a fan for flowing ambient air through the cooling duct, past the venturi, and out the exhaust vent.

2. A vent assembly as defined in claim 1, further comprising a flapper disposed between the outlet of the condenser and the venturi.

3. A vent assembly as defined in claim 2, further comprising a ratchet mechanism operable responsive to a turning on and/or a turning off of the fan to progressively open the flapper.

4. A vent assembly as defined in claim 2, further comprising a motor to open and close the flapper.

5. A vent assembly as defined in claim 2, further comprising a door that when opened closes the flapper.

6. A vent assembly as defined in claim 1, wherein the condenser comprises a tortuous path having at least one surface in thermal communication with the cooling duct.

7. A vent assembly as defined in claim 1, further comprising a moisture duct in fluid communication with the condenser and the tub.

8. A vent assembly as defined in claim 1, wherein the vent is at least one of on a top of a door of the dishwasher, on a side of the door, on a bottom of the door, on a wall of the tub within a cabinet, on a top edge of the door, on a toe kick, or below the door.

9. A vent assembly as defined in claim 2, further comprising:

a sensor to measure a value representative of an environmental property in the dishwasher, wherein a degree of opening of the flapper is based on the measured value, and wherein the environmental property is at least one of a temperature and/or a humidity.

10. A method of venting exhaust air from a dishwasher, comprising:

circulating air through a condenser to condense moisture from the air;

operating a fan to pass ambient air through a cooling duct to thermally conduct heat from the condenser to the ambient air to condense the moisture;

drawing the air from the condenser into the cooling duct through a venturi; and venting a mixture of the ambient air and the air from the condenser through a vent to exhaust air from the dishwasher.

11. A method as defined in claim 10, further comprising operating a flapper disposed to control airflow from the condenser through the venturi.

12. A method as defined in claim 11, further comprising turning the fan off and on to progressively open the flapper.

13. A method as defined in claim 11, further comprising turning the fan off and on to operate a ratchet that controls an amount of opening of the flapper.

14. A method as defined in claim 11, further comprising closing the flapper in response to a door of the dishwasher opening.

15. A method as defined in claim 11, further comprising progressively opening the flapper as air is progressively exhausted via the vent.

16. A method as defined in claim 11, further comprising operating the flapper in response to air pressure.

17. A method as defined in claim 11, further comprising:

sensing at least one of an environmental property in the dishwasher; and adjusting a degree of opening of the flapper based on the sensed environmental property, wherein the environmental property is at least one of a temperature and/or a humidity.

18. A method of venting exhaust air from a dishwasher, comprising:

providing a vent assembly as defined in claim 1;

circulating air through the condenser to condense moisture from the air;

operating the fan to pass ambient air through the cooling duct to thermally conduct heat from the condenser to the ambient air to condense the moisture;

drawing the air from the condenser into the cooling duct through the venturi; and venting a mixture of the ambient air and the air from the condenser through the exhaust vent.

19. A method as defined in claim 18, further comprising operating a flapper disposed between the outlet of the condenser and the venturi to control airflow from the condenser through the venturi.

20. A method as defined in claim 19, further comprising turning the fan off and on to progressively open the flapper.

* * * * *